US005533887A

United States Patent [19]

Maruyama et al.

[11] Patent Number: 5,533,887

[45] Date of Patent: Jul. 9, 1996

[54] FLUID ROTARY APPARATUS HAVING TAPERED ROTORS

[75] Inventors: Teruo Maruyama, Hirakata; Yoshikazu Abe, Neyagawa, both of Japan

[73] Assignee: Matsushita Electric Industrial Co., Ltd., Osaka-fu, Japan

[21] Appl. No.: 233,273

[22] Filed: Apr. 26, 1994

[30] Foreign Application Priority Data

Apr. 27, 1993 [JP] Japan ..... 5-100910

[51] Int. Cl.[6] ..... F01C 1/16

[52] U.S. Cl. ..... 418/201.3; 418/143; 277/134

[58] Field of Search ..... 418/201.1, 201.3, 418/134, 143; 277/133, 134

[56] References Cited

U.S. PATENT DOCUMENTS 3,282,495 11/1966 Walls ..... 418/201.1
3,497,225 2/1970 Workman ..... 277/134
4,405,286 9/1983 Studer ..... 418/201.1

FOREIGN PATENT DOCUMENTS 384355 12/1932 United Kingdom ..... 418/201.3

*Primary Examiner*—Charles Freay
*Attorney, Agent, or Firm*—Wenderoth, Lind & Ponack

[57] ABSTRACT

A fluid rotary apparatus includes a casing, a plurality of screw rotors, and a driving device. The casing has a suction hole, a discharging hole, and an inner tapered surface. The rotors have thread grooves and are rotatably supported within the casing to be rotated synchronously in mesh with each other. An outer peripheral surface of each rotor has a flat surface approaching or sliding in contact with the inner tapered surface of the casing. The driving device rotates the rotors. Fluid is drawn through the suction hole, compressed, and discharged through the discharging hole by utilization of a change of a volume of a space defined by the plurality of screw rotors and the casing. A band-like chip seal is provided at the flat surface of each rotor. The chip seal has dynamic pressure notches at it surface to produce dynamic pressure from viscous fluid.

1 Claim, 13 Drawing Sheets

Fig. 16 - PRIOR ART
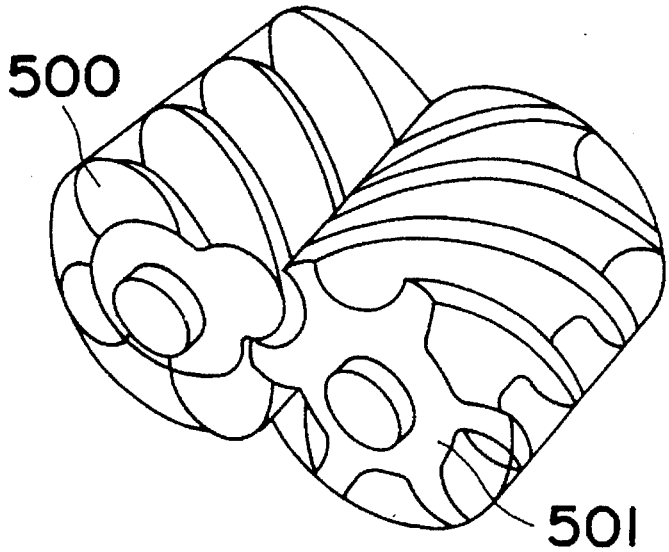
Fig. 17 - PRIOR ART
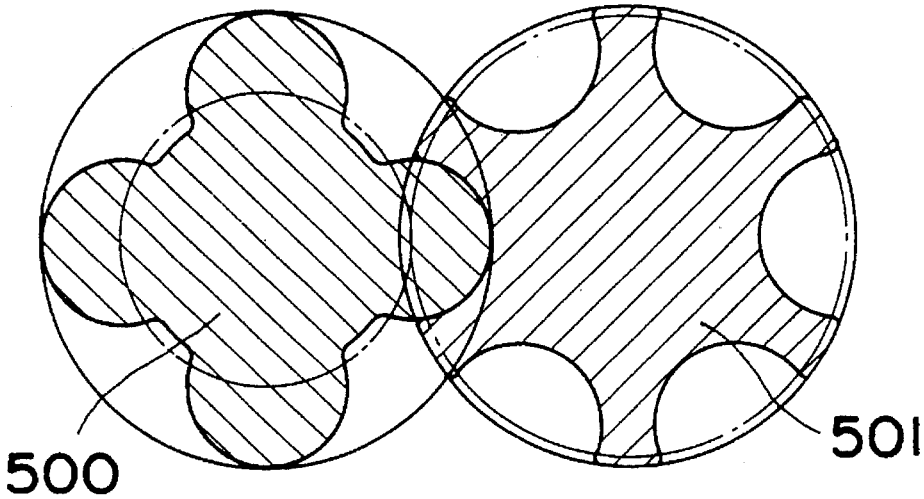

FLUID ROTARY APPARATUS HAVING TAPERED ROTORS

BACKGROUND OF THE INVENTION

The present invention relates to a fluid rotary apparatus widely applicable to a vacuum pump in semiconductor equipment, a compressor of a refrigerator or an air conditioner, etc.

Screw rotary machines have been used in the form of compressors or vacuum pumps in various fields utilizing vacuums, such as refrigeration, air conditioning, semiconductors, optics, foods, and medicines.

FIG. 16 shows an example of a conventional screw compressor having a male rotor 500 and a female rotor 501 arranged on two shafts parallel to each other. The rotors 500, 501 rotate in opposite directions like male and female screws meshed with each other. Tubular groove chambers in the pair of rotors defined by a casing and thread grooves of the rotors are compressed while a meshed point of the rotors is moved axially and compressed in accordance with the rotation of the rotors, so that the air is discharged.

More specifically, as shown in FIG. 17, the screw compressor includes the male rotor 500 with four convex surfaces and the female rotor 501 with six threads. When the rotors 500, 501 rotate in opposite directions, the volume of a space defined by the thread grooves and the casing is changed, so that the air is drawn, compressed, and discharged by utilizing this change of the volume. Since the air is drawn, compressed, and discharged sequentially by the thread grooves in the screw compressor of the above type, the torque changes less and the flow pulsates little, and moreover the rotary bodies are kept well balanced. Therefore, the screw compressor is advantageous in that it generates few vibrations, runs at high speeds and is of a compact structure.

In the meantime, the performance of the screw compressor is determined by the amount of internal leakage between the rotors and between the rotors and casing. The above internal leakage is detected specifically at the following points:

(1) at a point where the male rotor is meshed with the female rotor, through which the air leaks from the discharging side to the suction side;

(2) at a side gap of each rotor;

(3) at a gap between the outer periphery of each rotor and the inner surface of the casing, through which the air leaks from one thread groove to the other thread groove; and (4) at a path connecting adjacent thread grooves which is determined by the shape of the threads of the rotor, namely, a blow hole.

In order to avoid the leakage referred to above, the screw compressor has been processed highly accurately with the thermal expansion of each member taken into consideration and at the same time, the gap has been sealed by lubricating oil.

However, in the case where the above conventional screw rotary machine is to be applied to consumer equipment such as refrigerators, air conditioners for rooms or air conditioners for automobiles, the displacement (discharging amount per rotation) is normally 3–100 cc or so, whereby the efficiency of the compressor is greatly deteriorated due to the influences of the internal leakage as discussed above.

For all the merits of the screw-type rotary machines, i.e., low-vibration and low-noise, etc., it has been difficult to apply the screw-type rotary machines to consumer equipment, and the use of the machines has been restricted to large-size compressors, vacuum pumps and the like in the industrial field.

SUMMARY OF THE INVENTION

The object of the present invention is therefore to provide a fluid rotary apparatus showing high efficiency without losing the simple structural characteristics of a screw type pump.

In accomplishing these and other objects, according to one aspect of the present invention, there is provided a fluid rotary apparatus comprising: a casing having a suction hole, a discharging hole, and an inner tapered surface; a plurality of screw rotors having thread grooves and rotatably supported within the casing to be rotated synchronously in mesh with each other, an outer peripheral surface of each of the plurality of screw rotors having a flat surface approaching or sliding in contact with the inner tapered surface of the casing; and a driving device for rotating the rotors, whereby fluid is drawn through the suction hole, compressed, and discharged through the discharging hole by utilization of a change of a volume of a space defined by the plurality of screw rotors and the casing.

According to another aspect of the present invention, there is provided a fluid rotary apparatus comprising: a casing having a suction hole, a discharging hole and an inner tapered surface; a main screw rotor having thread grooves and rotatably supported within the casing, an outer peripheral surface of the main screw rotor having a flat surface approaching or sliding in contact with the inner tapered surface of the casing; a driven screw rotor having thread grooves, rotatably supported within the casing to be rotated synchronously in mesh with the main screw rotor, and driven by the main screw rotor, an outer peripheral surface of the driven screw rotor having a flat surface approaching or sliding in contact with the inner tapered surface of the casing; and a driving device for rotating the rotors, whereby fluid is drawn through the suction hole, compressed, and discharged through the discharging hole by utilization of a change of volumes of spaces defined by the main and driven screw rotors and the casing.

BRIEF DESCRIPTION OF THE DRAWINGS

These and other objects and features of the present invention will become clear from the following description taken in conjunction with the preferred embodiments thereof with reference to the accompanying drawings, in which:

FIG. 16 shows a conventional screw compressor; and

FIG. 17 is a sectional view of the conventional screw compressor.

DETAILED DESCRIPTION OF THE PREFERRED EMBODIMENTS

Figure 1:
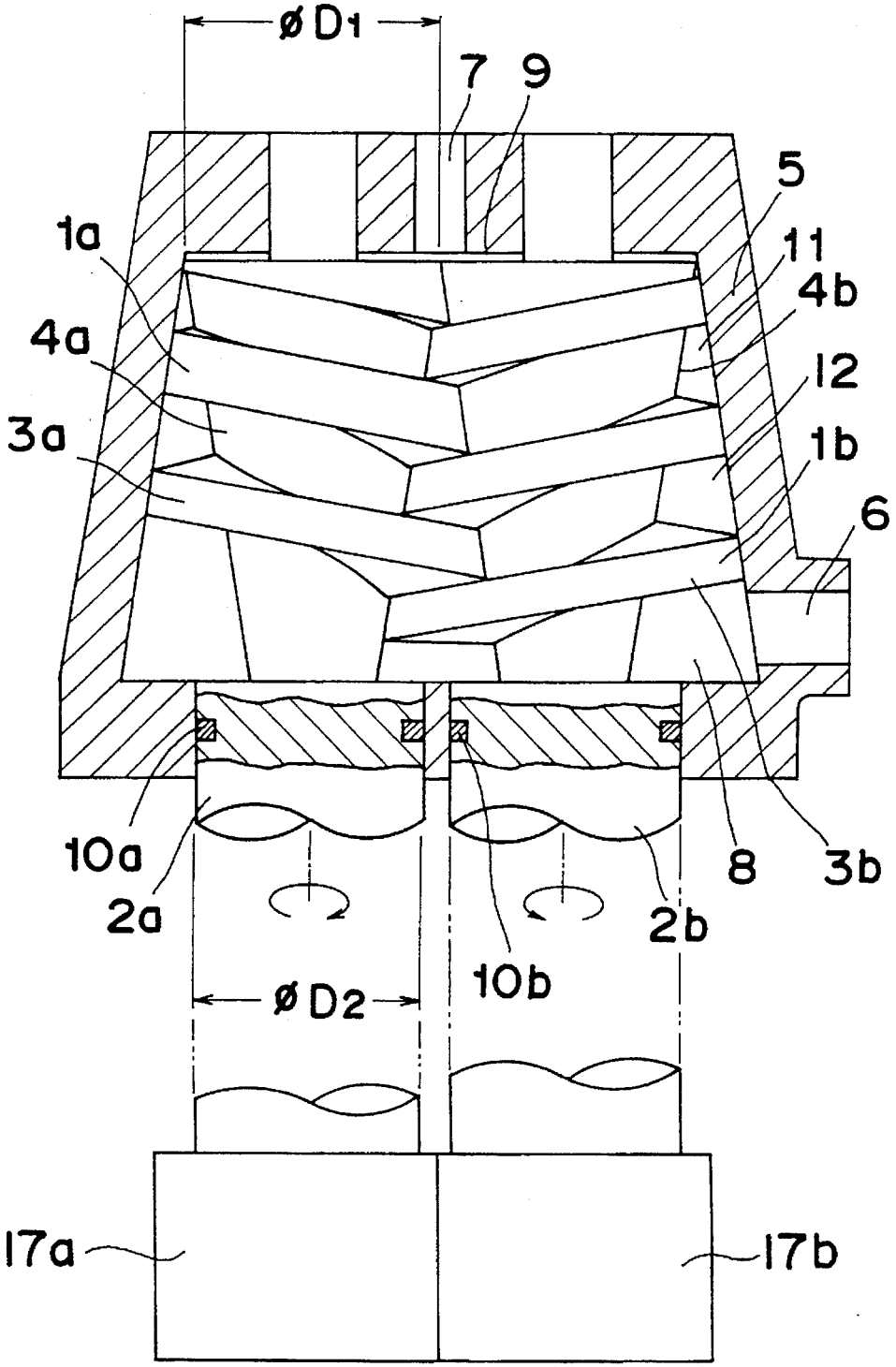
FIG. 1 is a front sectional view of a fluid rotary apparatus according to a first embodiment of the present invention.

Before the description of the present invention proceeds, it is to be noted that like parts are designated by like reference numerals throughout the accompanying drawings.

Preferred embodiments of the present invention will be discussed in detail with reference to the drawings.

Referring to FIG. 1 showing a first embodiment of the present invention, reference numerals 1*a*, 1*b* represent rotors; 2*a*, 2*b* represent rotary shafts connected to rotors 17*a*, 17*b*; 3*a*, 3*b* represent thread grooves formed in the corresponding rotors 1*a*, 1*b*; and 4*a*, 4*b* represent taper shafts at the center of the corresponding rotors 1*a*, 1*b*. The rotor 1*a* is constituted by the thread grooves 3*a* and the taper shafts 4*a*. On the other hand, the rotor 1*b* is constituted by the thread grooves 3*b* and the taper shafts 4*b*. The rotors 1*a*, 1*b* are accommodated in a casing 5 which has a suction hole 6 and a discharge hole 7. A suction chamber 8 and a discharge chamber 9 are defined in the casing 5. The rotary shafts 2*a*, 2*b* are provided with floating seals 10*a*, 10*b*. A fluid transfer chamber 11 is formed at the upstream side, while a fluid transfer chamber 12 is formed at the downstream side.

The rotors 1*a*, 1*b* are arranged on two shafts parallel to each other, and the thread grooves 3*a*, 3*b* of the rotors 1*a*, 1*b* are engaged with each other and rotated in opposite directions.

The thread grooves 3*a*, 3*b* are tapered in profile. The taper shafts 4*a*, 4*b* are also tapered in inverse relation to the thread grooves 3*a*, 3*b*. The volume of a sealed space formed by the thread grooves 3*a*, 3*b*, taper shafts 4*a*, 4*b*, and casing 5 is gradually reduced during the upward movement of the space towards the discharging side in accordance with the rotation of the rotors 1*a*, 1*b*.

In the first embodiment of FIG. 1, the whole casing 5 is enclosed by a container (not shown) of the same high pressure as the discharging pressure. Since the outer diameter D1 of each rotor at the discharging side is made approximately equal to the outer diameter D2 of the corresponding rotary shaft at the suction side, the thrust load applied to the rotor is kept close to zero. The leakage of a cooling medium from the high pressure side to the suction chamber 8 is prevented by the floating seals 10*a*, 10*b*.

Figure 2:
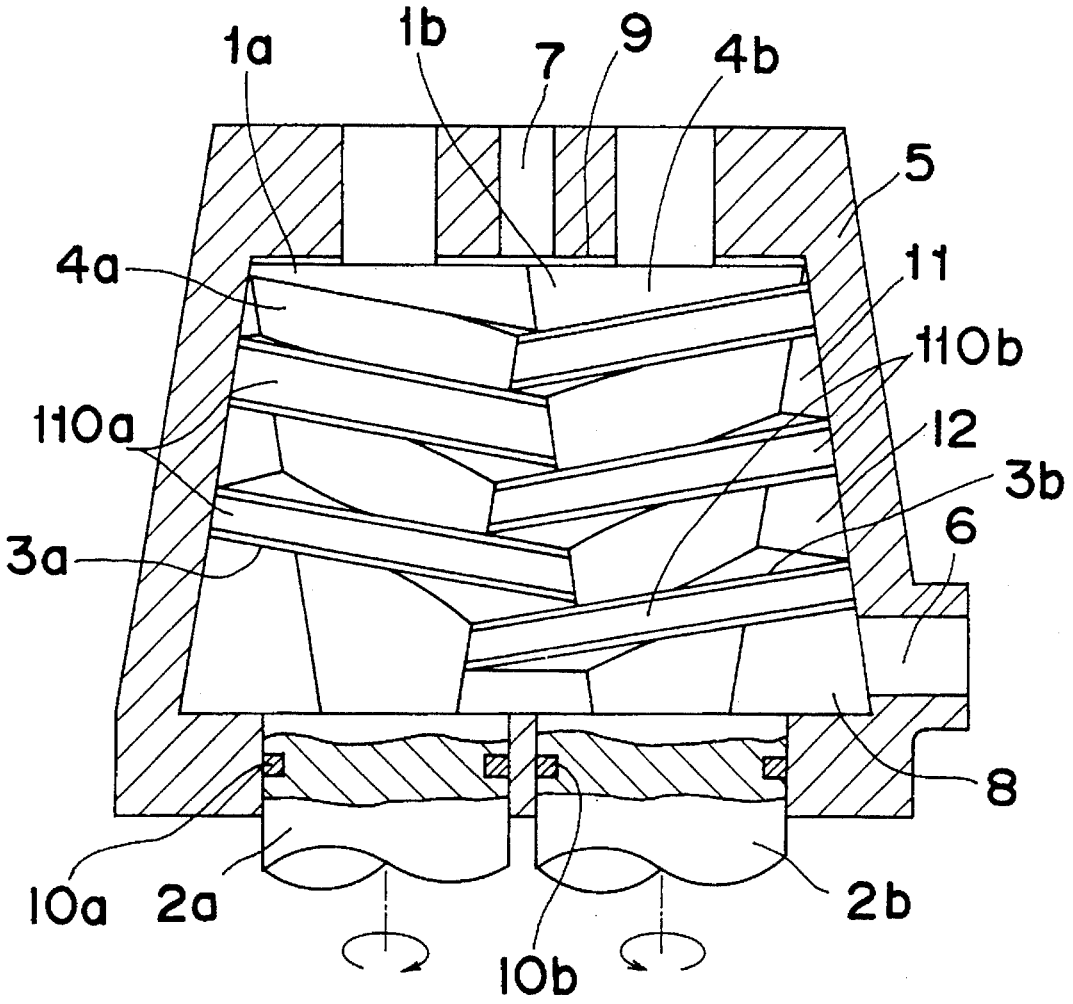
FIG. 2 is a front sectional view of a fluid rotary apparatus according to a second embodiment of the present invention.

FIG. 2 shows a second embodiment of the present invention, wherein band-like chip seals 110*a*, 110*b* are provided at the flat surfaces in the outer periphery of the thread grooves 3*a*, 3*b* approaching the casing 5 and the taper shafts 4*a* and 4*b*. This kind of chip seal is effective to prevent the internal leakage in a compressor such as a scroll compressor to thereby improve the efficiency of the compressor. However, since the male and female rotors of the conventional screw compressor are curved in profile as is clear from FIG. 17 and moreover, a contact point of the rotors is sequentially changed by the rotating angles of the rotors, the chip seals could not be employed in the conventional screw rotary machines. Conversely, owing to the flat surfaces of a sufficient width in the outer periphery of the thread grooves, the second embodiment allows conical chip seals at the flat surfaces. The chip seal can be made of polytetrafluoroethylene such as "Teflon" which is a trademark.

Figure 3:
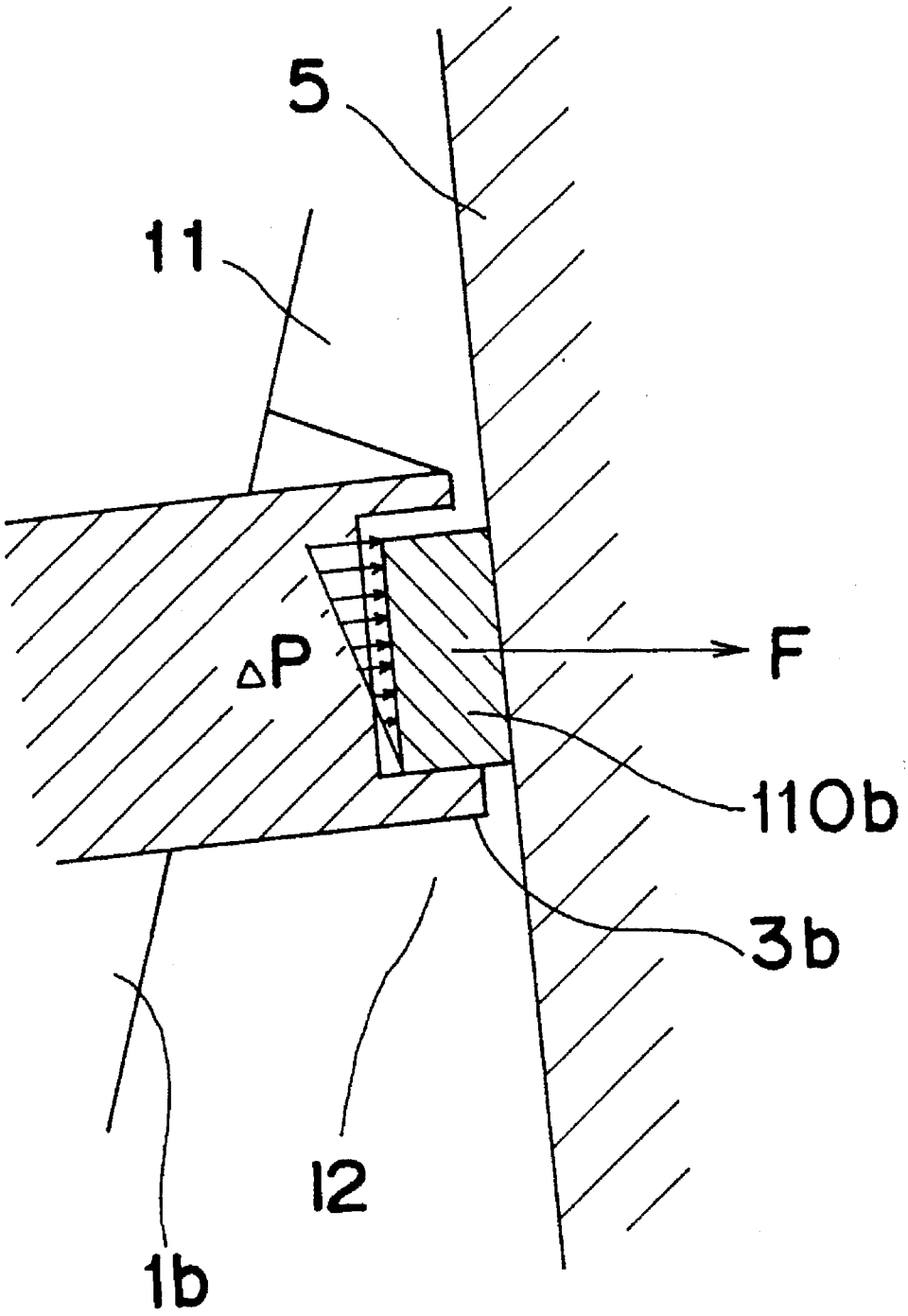
FIG. 3 is a partially enlarged view of FIG. 2.

FIG. 3 indicates the working principle of the above chip seals. When the second embodiment is applied to a compressor, the pressure of the upstream transfer chamber 11 is larger than that of the downstream transfer chamber 12. The pressure difference $\Delta P$ is impressed to the chip seal 10*b* in the centrifugal direction as shown in FIG. 3. Moreover, the centrifugal force F is applied also to the chip seal 10*b*, in addition to the pressure difference $\Delta P$. As a result, the chip seal 10*b* is pressed to the inner surface of the casing 5, thereby shutting a leakage path from the upstream transfer chamber 11 to the downstream transfer chamber 12.

Figure 4:
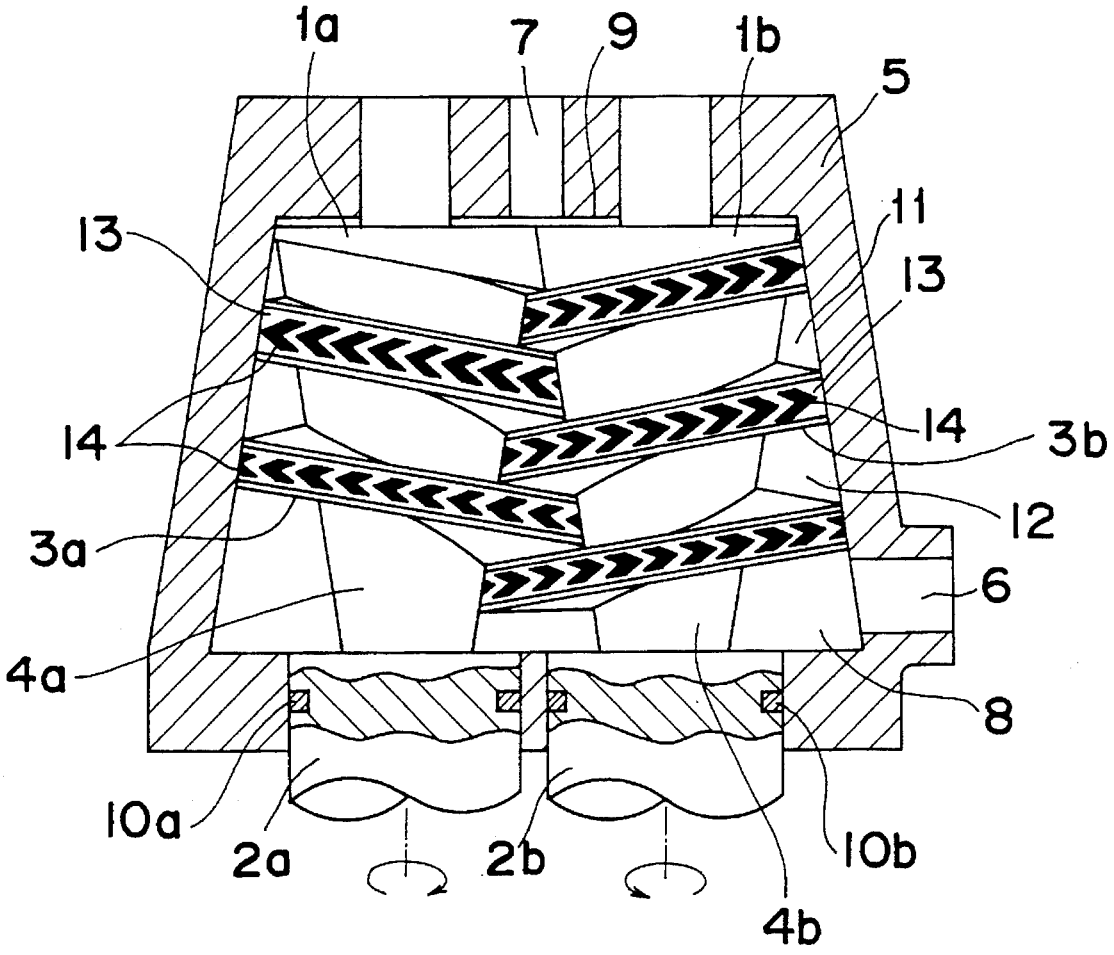
FIG. 4 is a front sectional view, according to a third embodiment of the present invention, when dynamic pressure notches are formed on the surfaces of chip seals in the fluid rotary apparatus in FIG. 2.
Figure 5:
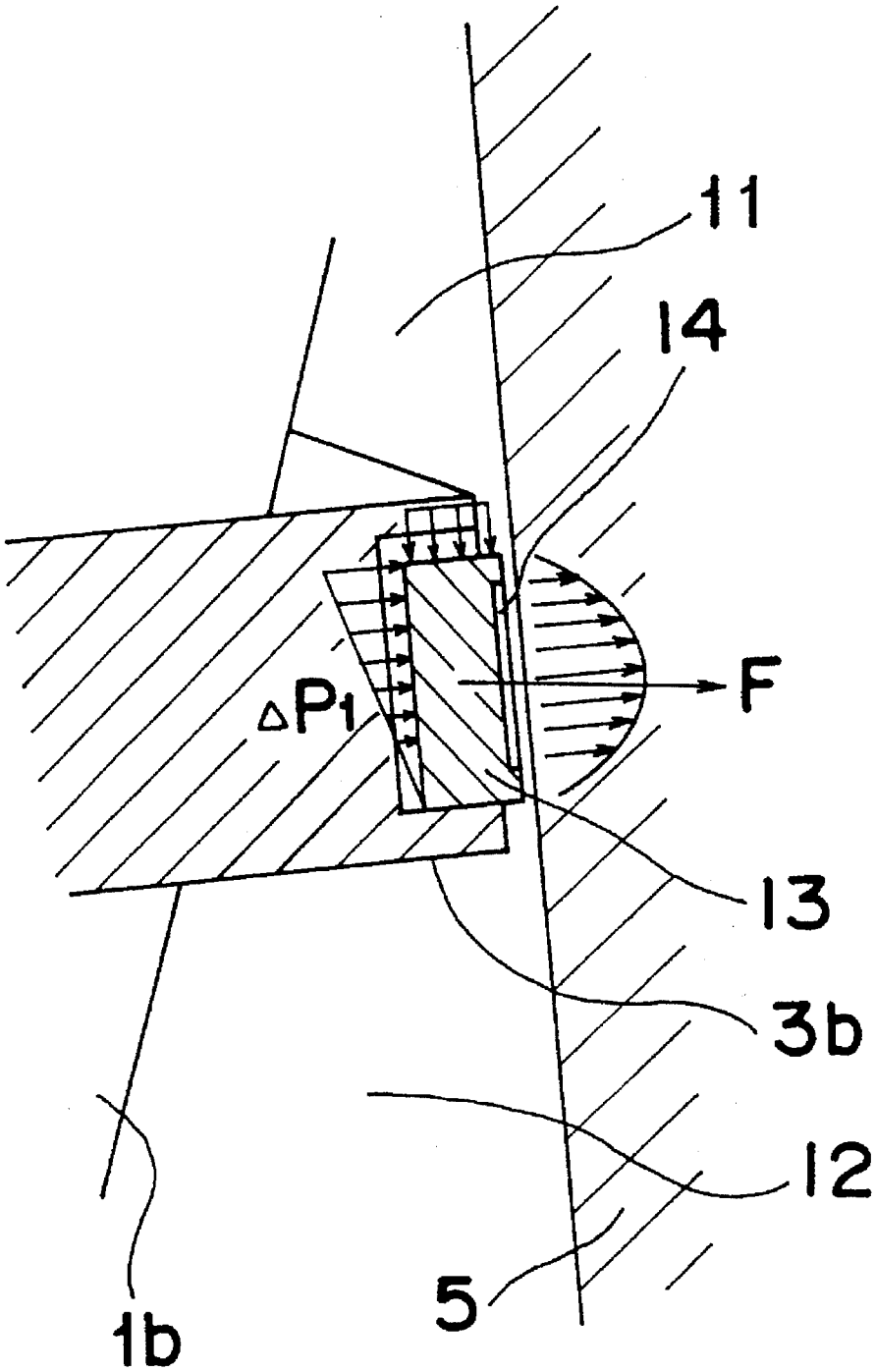
FIG. 5 is a partially enlarged view of FIG. 4.

FIG. 4 shows a fluid rotary apparatus according to a third embodiment of the present invention, wherein dynamic pressure notches 14 are formed at the surfaces of the chip seals 13 to obtain effects of dynamic pressure from viscous fluid. The working principle is illustrated in FIG. 5. Since the surface of each chip seal 13 and the inner surface of the casing 5 assume large relative speeds, wedge pressure $\Delta P_2$ is produced by the dynamic pressure notch 14, with floating the chip seal 13 on the order of several micrometers in spite of the centrifugal force F and the pressure difference $\Delta P_1$. Therefore, the chip seal 13 shows no abrasion even after a long period of use. The reliability is improved and the mechanical sliding loss is reduced.

Figure 6:
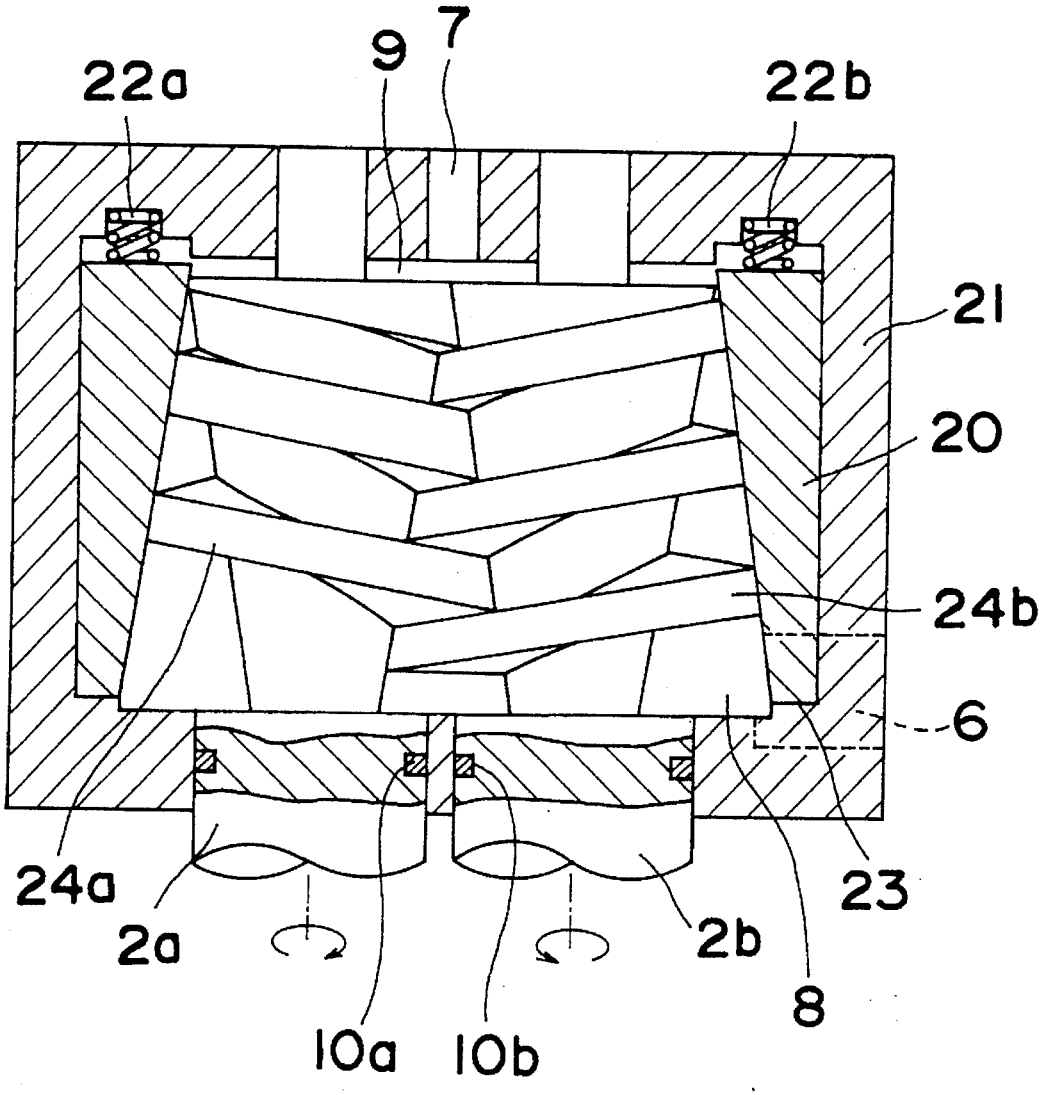
FIG. 6 is a front sectional view of a fluid rotary apparatus according to a fourth embodiment of the present invention provided with a movable casing for prevention of compression of liquid.
Figure 7:
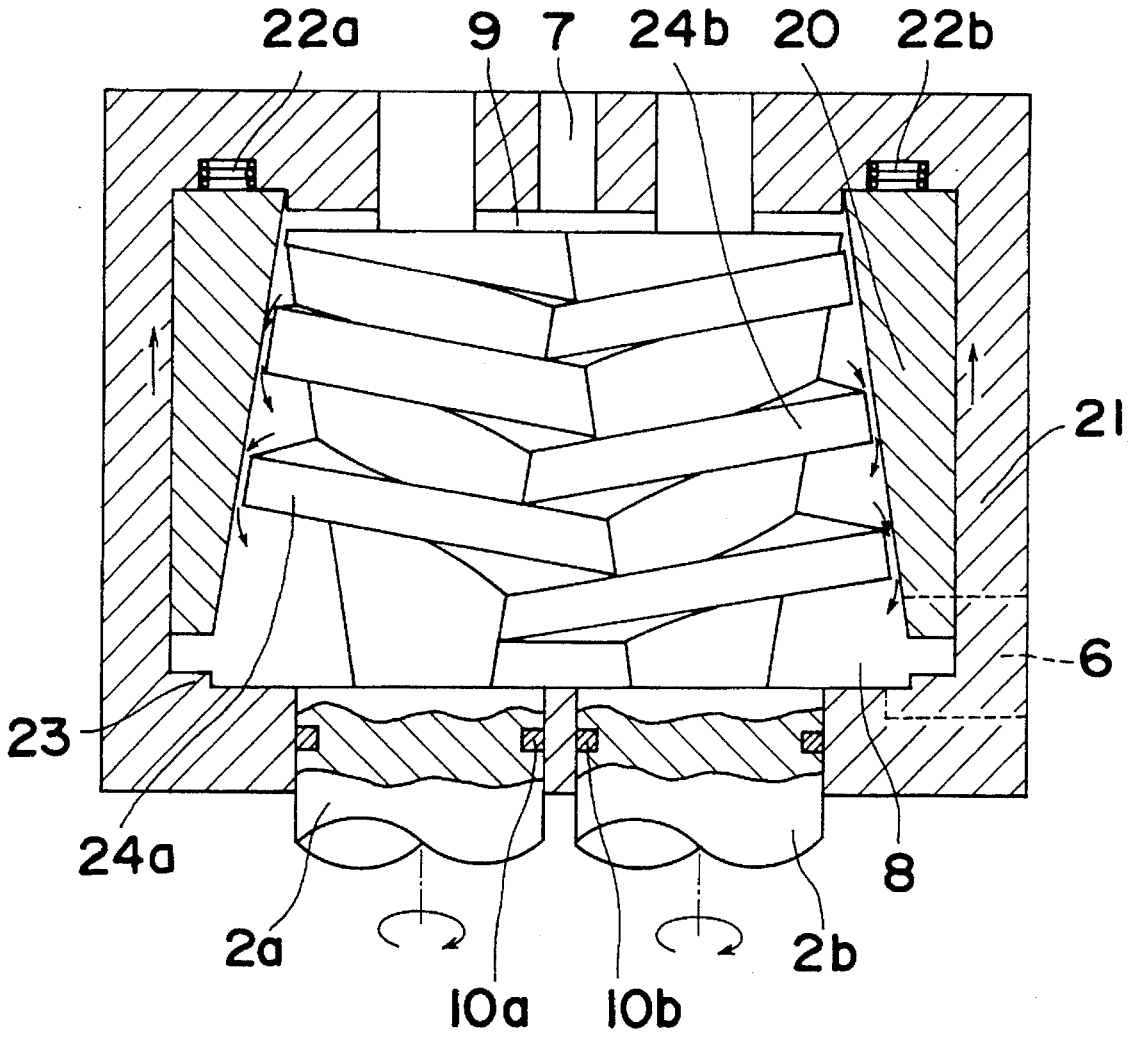
FIG. 7 is a diagram showing the state when liquid is compressed in the apparatus of FIG. 6.

FIGS. 6 and 7 show a fourth embodiment intended to prevent an excessive pressure during compressing of liquid and to improve the reliability. For this purpose, the inner surface accommodating each rotor is rendered movable in the axial direction along the tapered casing 5. In FIGS. 6 and 7, 20 represents a movable casing having an inner tapered surface; 21 represents a fixed casing for housing the movable casing 20; 22*a*, 22*b* represent compression springs for applying a downward force to the movable casing 20 as shown in FIGS. 6 and 7; and 24*a*, 24*b* represent rotors. The height of the movable casing 20 in the axial direction is regulated by a positioning part 23 formed in the fixed casing 21.

As shown in FIG. 7, when liquid is compressed, the movable casing 20 floats upward in FIG. 7 to form a gap between the outer surfaces of the rotors 24*a*, 24*b* and the inner tapered surface of the movable casing 20 and consequently the pressurized liquid runs downstream via the gap. Accordingly, the reliability of the compressor is enhanced.

Figure 8:
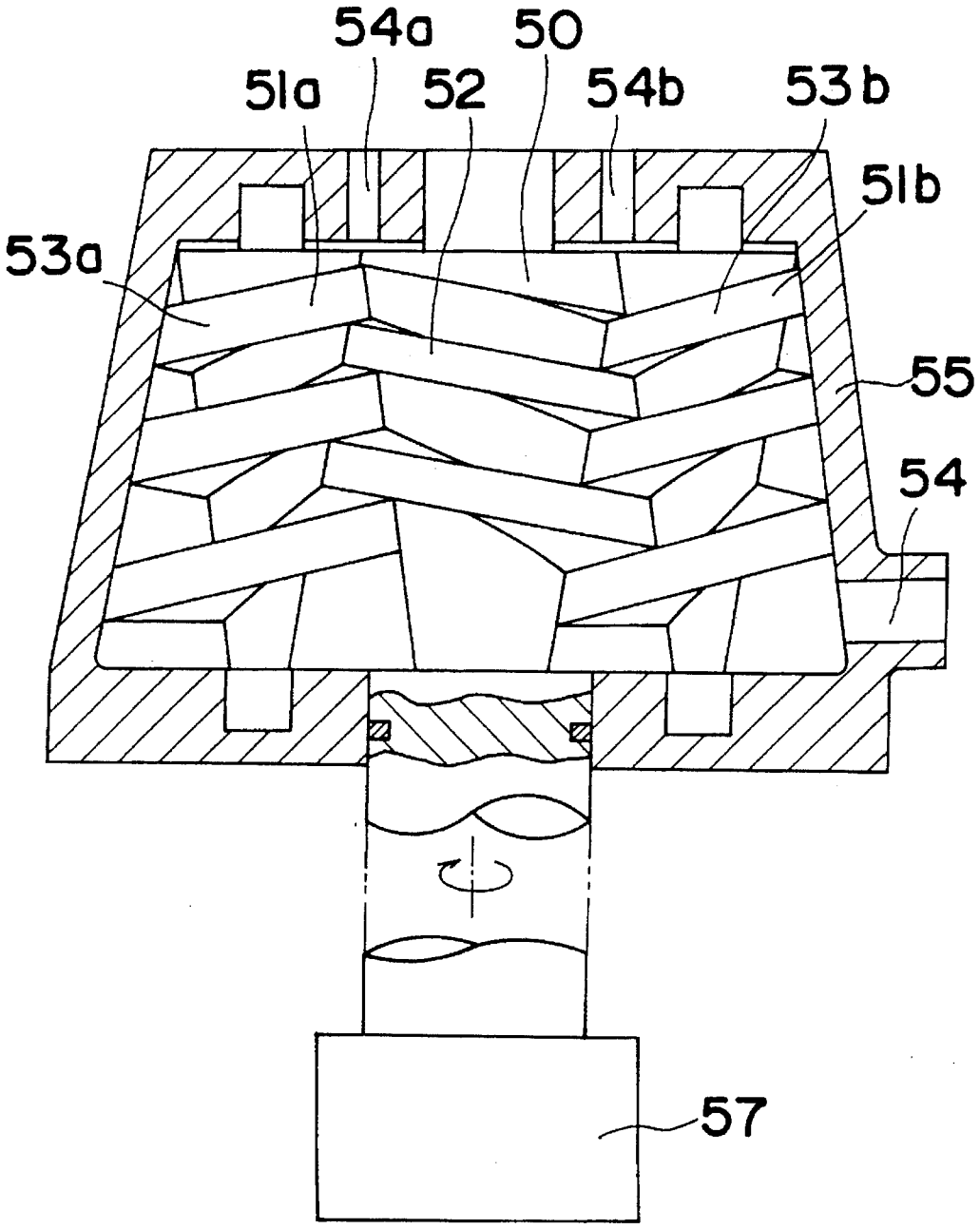
FIG. 8 is a front sectional view of a fluid rotary apparatus having a screw rotor constituted of three shafts according to a fifth embodiment of the present invention.

A fluid rotary apparatus according to a fifth embodiment of the present invention in FIG. 8 has a screw rotor of three shafts, namely, a center screw rotor 50 as a main shaft connected to a motor 57 via a rotary shaft 2*c* and right and left screw rotors 51*a*, 51*b* as driven shafts driven by the main shaft 50. Also in FIG. 8 52 represents a thread groove of the main shaft 50; 53*a*, 53*b* represent thread grooves of the driven shafts 51*a*, 51*b*; 54 represent a suction hole; 54*a*, 54*b* represent discharging holes; and 55 represent a casing with an inner tapered surface.

Figure 9:
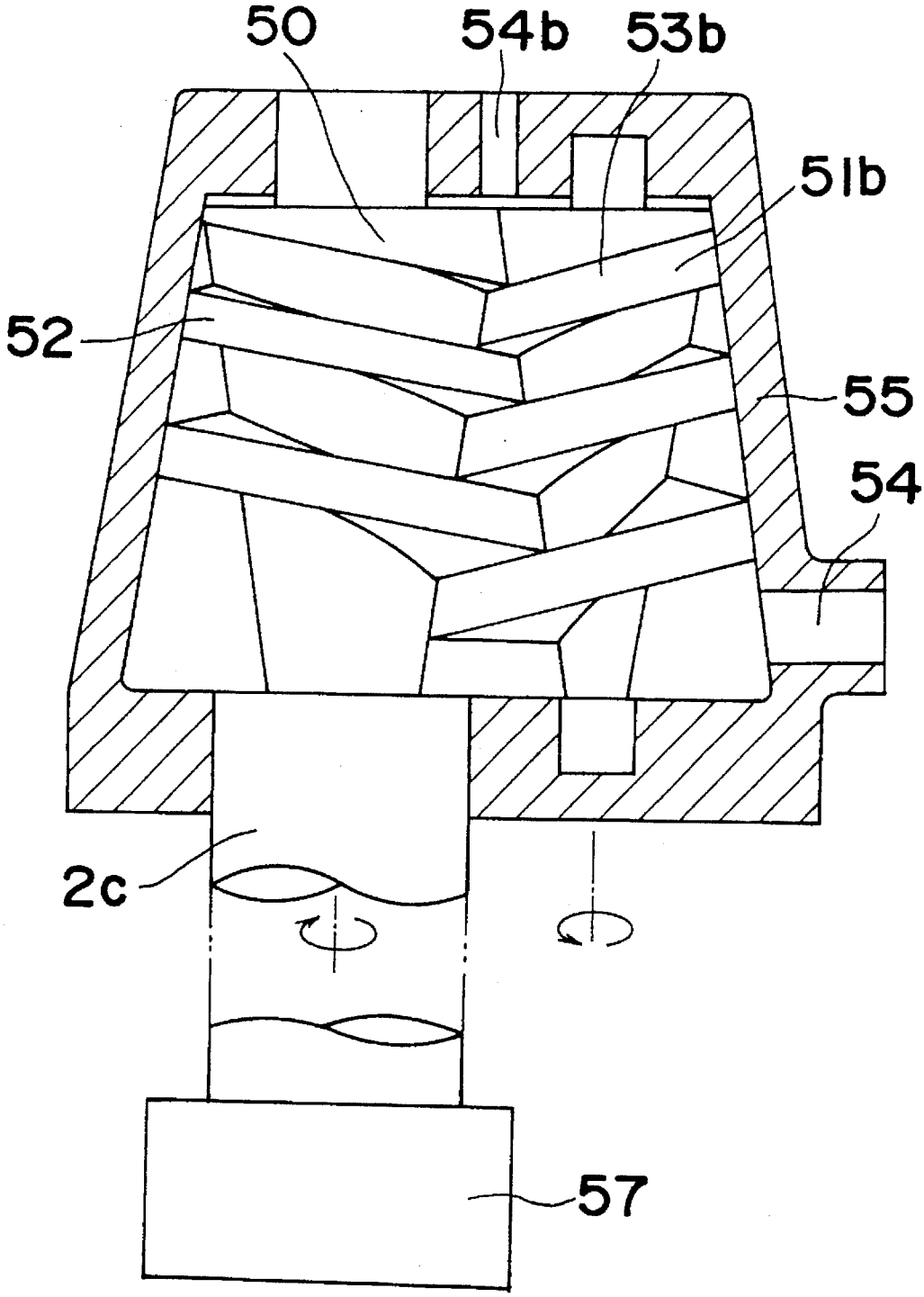
FIG. 9 is a front sectional view of a fluid rotary apparatus having a screw rotor constituted by two shafts according to a sixth embodiment of the present invention.

In FIG. 9, a screw rotor of a fluid rotary apparatus according to a sixth embodiment of the present invention is constituted by two shafts, and the diameters of the rotors are made different from each other. Reference numeral 50 represents a main shaft rotor connected to a rotary shaft 2*c*, and 51*b* represents a driven shaft rotor driven by the main shaft rotor 50.

Figure 10:
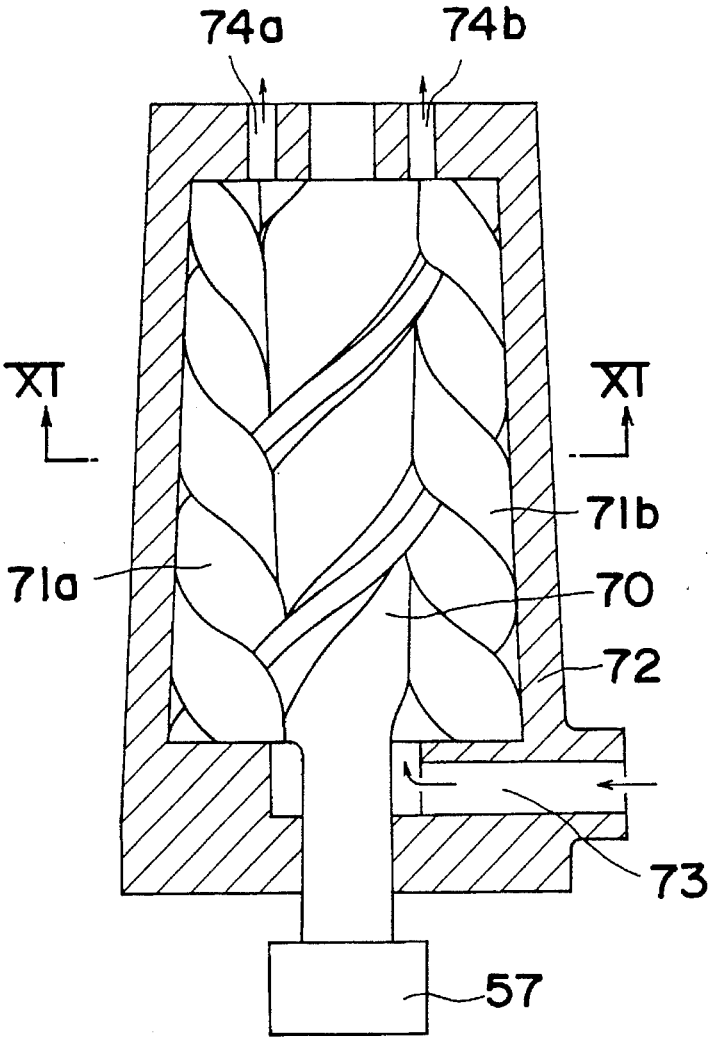
FIG. 10 is a front sectional view of a fluid rotary apparatus according to a seventh embodiment of the present invention having a screw rotor constituted by three shafts, each shaft being a double thread screw.

FIG. 10 shows a fluid rotary apparatus according to a seventh embodiment of the present invention when a screw rotor comprises three shafts 70, 71*a*, 71*b*, and each rotor 70, 71*a*, 71*b* is a double thread screw.

Figure 11:
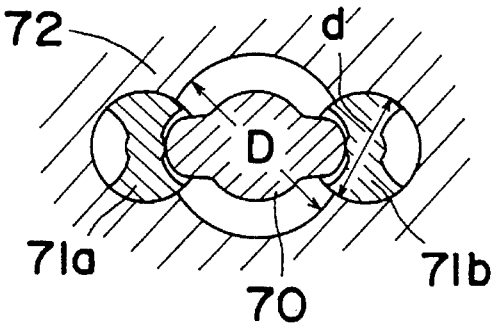
FIG. 11 is a sectional view taken along the line XI—XI of FIG. 10.

FIG. 11 is a sectional view taken along the line XI—XI of FIG. 10. Reference numeral 70 represents a main shaft rotor connected to a motor 77; 71*a*, 71*b* represent driven shaft rotors driven by the main shaft rotor 70; 72 represents a casing; 73 represents a suction hole; and 74*a*, 74*b* represent discharging holes. As is clearly shown in FIG. 11, the diameter D of the main shaft rotor 70 is different from the diameter d of the driven rotors 71*a*, 71*b*. The inner surface of the casing 72 accommodating the rotors 70, 71*a*, 71*b* is tapered.

When the diameter of the main shaft rotor 70 is set different from that of the driven shaft rotors 71*a*, 71*b* and the width of each thread groove is optimized, the torque of the fluid pressure applied to each driven shaft 71*a*, 71*b* becomes zero, so that timing gears can be dispensed with, similar to an IMO pump.

As compared with a conventional IMO pump not accompanying the volume change, the sealed space defined by the rotors and casing in the fluid rotary apparatus in FIGS. 10 and 11 is gradually reduced in volume towards the downstream side, that is, the sealed space performs a compressing action. Therefore, the apparatus in FIGS. 10 and 11 is utilizable as a compressor.

Figure 12:
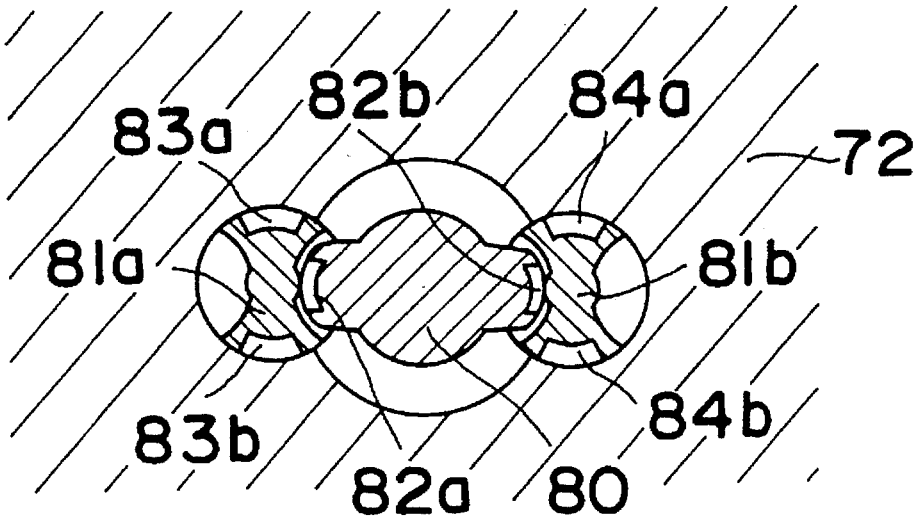
FIG. 12 is a sectional view of a fluid rotary apparatus according to an eighth embodiment of the present invention with rotors respectively provided with chip seals.

FIG. 12 shows a fluid rotary apparatus according to an eighth embodiment of the present invention to improve the sealing efficiency. Chip seals 82*a*, 82*b*, 83*a*, 83*b*, 84*a*, 84*b* are attached to a main shaft rotor 80 and driven shaft rotors 81*a*, 81*b* of this fluid rotary apparatus, most of which is similar to that in FIGS. 10 and 11.

Figure 13:
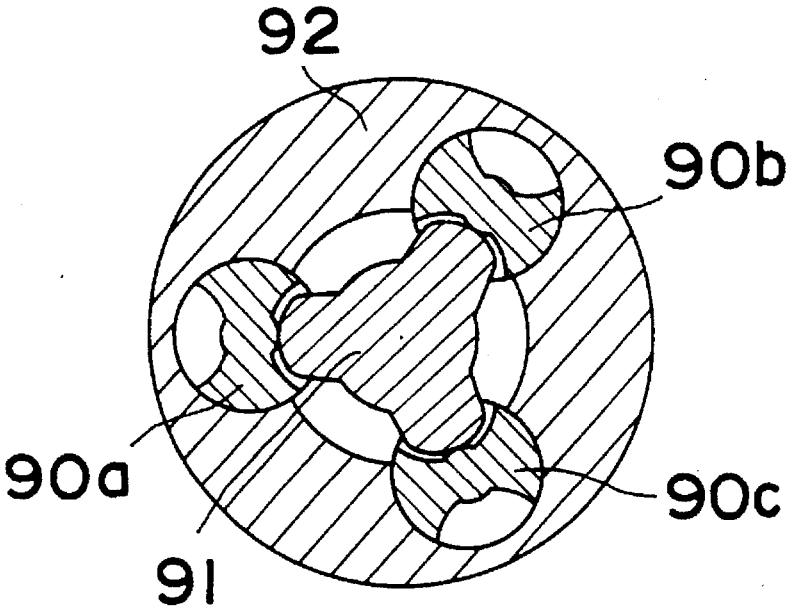
FIG. 13 is a sectional view of a fluid rotary apparatus according to a ninth embodiment of the present invention having a screw rotor constituted by four shafts, a main shaft of which is a triple thread screw.

FIG. 13 shows a fluid rotary apparatus according to a ninth embodiment of the present invention which has three driven shaft rotors 90*a*, 90*b*, 90*c* and a main shaft rotor 91 formed of a triple thread screw. All the rotors are housed in a circular casing 92.

Figure 14:
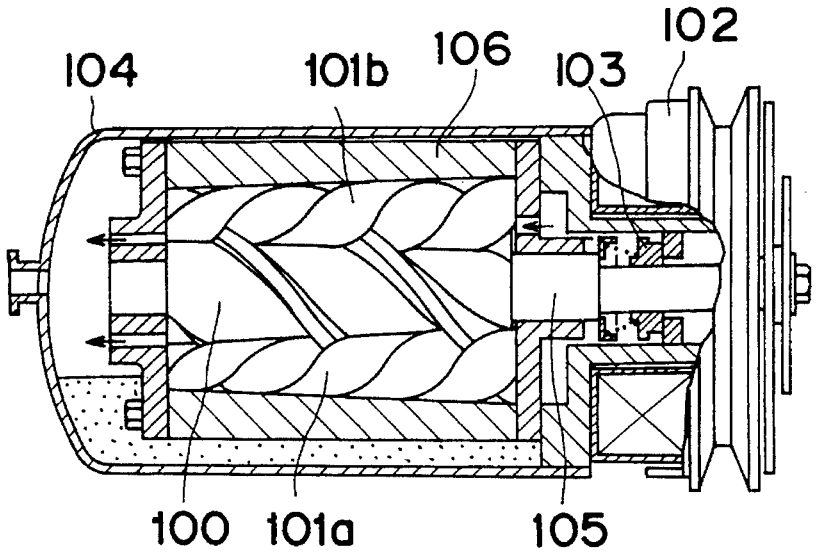
FIG. 14 is a front sectional view when the seventh embodiment of the invention is applied to an air conditioner for an automobile.

When the seventh embodiment of the present invention is applied to a compressor for air conditioning of automobiles, the concrete structure will be as represented in FIG. 14. Reference numeral 100 represents a main shaft rotor connected to a rotary shaft 105; 101*a*, 101*b* represent driven shaft rotors; 102 represents a clutch; 103 represents a mechanical seal; 104 represents a housing; and 106 represents a casing.

Figure 15:
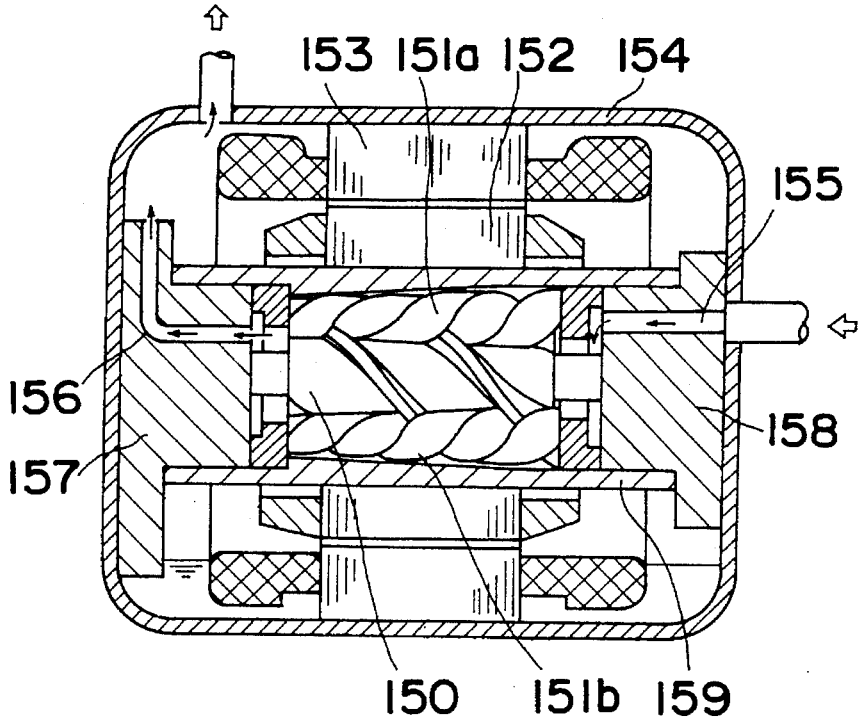
FIG. 15 is a front sectional view when the seventh embodiment of the invention is applied to a refrigerator compressor.

FIG. 15 illustrates another application of the seventh embodiment of the present invention to a refrigerator compressor. Reference numeral 150 represents a main shaft rotor; 151*a*, 151*b* represent driven shaft rotors; 152 represents a rotor of a motor; 153 represents a stator of the motor; 154 represents a housing; 155 represents a suction path; 156 represents a discharging path; 157 represents a side plate at the discharging side; 158 represents a side plate at the suction side; and 159 represents a casing fixed to the rotor 152 of the motor. The main shaft rotor 150 is fixed to the side plates 157, 158 at both ends thereof. The driven shaft rotors 151*a*, 151*b* rotate as satellite gears around the main shaft rotor 150 along with the casing 159 and the rotor 152 of the motor.

When the present invention is applied to a compressor or pump, it becomes possible to form a seal part with a sufficiently large sealing area at a portion where the largest internal leakage is produced when each rotor (rotating side) slides in touch with or approaches the inner surface of a casing (fixed side).

In contrast to the conventional screw rotary machines which form the aforementioned seal part by means of a "line" in the combination of curved surfaces (concave surface and convex surface), the seal part is obtained by a "surface" according to the present invention. Accordingly, the flow resistance at the seal part is sufficiently large to decreasing the internal leakage remarkably.

Moreover, the seal part can be utilized to form a band-like chip seal in a scroll compressor or the like, thus contributing to a further decrease of the internal leakage.

As is fully described hereinabove, the fluid rotary apparatus of the present invention can be used in compressors, vacuum pumps and the like which enjoy high efficiency even with a small displacement without losing the advantageous features, i.e., low vibration and low noise, of screw rotary apparatus.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A fluid rotary apparatus comprising:

a casing having a suction hole, a discharging hole, and an inner tapered surface;

a plurality of screw rotors having thread grooves and being rotatably supported within the casing to be rotated synchronously in mesh with each other, an outer peripheral surface of each of the plurality of screw rotors having a flat surface approaching or sliding in contact with the inner tapered surface of the casing; and a driving device for rotating the rotors, whereby fluid is drawn through the suction hole, compressed, and discharged through the discharging hole by utilization of a change of volume of a space defined by the plurality of screw rotors and the casing;

wherein a band-like chip seal is provided at the flat surface of each rotor; and wherein the chip seal has dynamic pressure notches at its surface to produce dynamic pressure from viscous fluid.

* * * * *